US009181893B2

(12) United States Patent
Kim et al.

(10) Patent No.: US 9,181,893 B2
(45) **Date of Patent: *Nov. 10, 2015**

(54) ELECTRONICALLY CONTROLLED FUEL INJECTION VALVE

(75) Inventors: Dong-Hun Kim, Ulsan (KR); Seung-Hyup Ryu, Ulsan (KR); Tae-Hyung Park, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 214 days.

This patent is subject to a terminal disclaimer.

(21) Appl. No.: 13/997,731

(22) PCT Filed: Dec. 23, 2011

(86) PCT No.: PCT/KR2011/010037

§ 371 (c)(1), (2), (4) Date: Jul. 26, 2013

(87) PCT Pub. No.: WO2012/091367

PCT Pub. Date: Jul. 5, 2012

(65) Prior Publication Data

US 2013/0332048 A1 Dec. 12, 2013

(30) Foreign Application Priority Data

Dec. 28, 2010 (KR) ..... 10-2010-0136403
Dec. 28, 2010 (KR) ..... 10-2010-0136405

(51) Int. Cl.

| | |
|---|---|
| ***F02M 51/00*** | (2006.01) |
| ***F02D 41/38*** | (2006.01) |
| ***F02M 61/10*** | (2006.01) |
| ***F02M 63/00*** | (2006.01) |
| ***F02M 47/02*** | (2006.01) |
| *F02M 61/20* | (2006.01) |

(52) U.S. Cl.

CPC ..... *F02D 41/38* (2013.01); *F02M 47/02* (2013.01); *F02M 61/10* (2013.01); *F02M 63/001* (2013.01); *F02M 47/027* (2013.01); *F02M 61/205* (2013.01); *F02M 2200/50* (2013.01)

(58) Field of Classification Search

CPC ..... F02M 61/10; F02M 51/0671
USPC ..... 123/490; 239/584, 585.1, 585.5
See application file for complete search history.

(56) References Cited

U.S. PATENT DOCUMENTS 5,988,533 A 11/1999 Augustin
6,161,773 A 12/2000 Camplin et al.

(Continued)

FOREIGN PATENT DOCUMENTS

JP 07-324665 A 12/1995
JP 10-131828 A 5/1998

(Continued)

*Primary Examiner* — John Kwon
(74) *Attorney, Agent, or Firm* — Rabin & Berdo, P.C.

(57) ABSTRACT

An electronically controlled fuel injection valve can control the time to inject fuel and the amount of fuel to be injected in response to a control signal independently from the operating condition of an engine unlike a traditional mechanical fuel injection valve. The electronically controlled fuel injection valve employs a control method for fuel injection that increases the force of lifting up a cutoff needle of an injection controller by delivering high-pressure fuel to a lower pressure chamber via a control needle, thereby rapidly controlling fuel injection, has a simple structure making it easy to assemble, replace and precisely machine parts, and has a simple flow path structure which facilitates fabrication.

4 Claims, 11 Drawing Sheets

(56) References Cited

U.S. PATENT DOCUMENTS

| | | | | |
|---|---|---|---|---|
| 2010/0199948 | A1* | 8/2010 | Rogak et al. | 123/304 |
| 2011/0006130 | A1* | 1/2011 | Kondo et al. | 239/71 |

FOREIGN PATENT DOCUMENTS

| | | | |
|---|---|---|---|
| JP | 2000-087821 | A | 3/2000 |
| JP | 2010-249103 | A | 11/2010 |

* cited by examiner

ELECTRONICALLY CONTROLLED FUEL INJECTION VALVE

TECHNICAL FIELD

The present invention relates, in general, to an electronically controlled fuel injection valve and, more particularly, to an electronically controlled fuel injection valve which can independently control the time to inject fuel and the amount of fuel to be injected in response to a control signal sent from the operating condition of an engine, and when fuel is not injected, prevent a nozzle part from being constantly subjected to high pressure due to the nozzle part being not supplied with fuel.

BACKGROUND ART

In response to the development of electronic control technologies, it is the rapidly-growing trend to electronically control engines. Fuel injection methods using a common rail are being widely applied to electronically controlled engines since fuel injection can be performed under high pressure even with a low load and can be easily performed in response to a control signal.

A variety of research and development is being performed on electronically controlled fuel injection valves that are key devices of common rail fuel injection systems. In order to improve the performance of the fuel injection valve, a large number of patent applications are being filed for various types of fuel injection valve driving mechanisms.

A traditional mechanical fuel injection valve is configured such that fuel is injected by lifting up a needle using only the pressure of fuel that is fed into a chamber of a nozzle part. Since injection characteristics such as the time to inject fuel and the amount of fuel to be injected are always uniform, control over fuel injection cannot be performed independently from the operating condition of an engine and this can be problematic.

DISCLOSURE

Technical Problem

Accordingly, the present invention has been made keeping in mind the above problems occurring in the related art, and is intended to provide an electronically controlled fuel injection valve which can control the time to inject fuel and the amount of fuel to be injected in response to a control signal independently from the operating condition of an engine unlike a traditional mechanical fuel injection valve, which employs a control method for fuel injection that increases the force of lifting up a cutoff needle of an injection controller by delivering high-pressure fuel to a lower pressure chamber via a control needle, thereby rapidly controlling fuel injection, which has a simple structure making it easy to assemble, replace and precisely machine parts, and which has a simple flow path structure which facilitates fabrication.

Technical Solution

In order to accomplish the above objects, the present invention provides an electronically controlled fuel injection valve that includes: a valve body having defined therein a first flow path along which fuel is fed through a fuel supply port, and having a control valve housing in an upper portion thereof; a nozzle part coupled to a lower portion of the valve body, and having defined therein a nozzle chamber which is filled with fuel that is supplied via the first flow path so that a needle disposed therein is pressed upward, whereby the needle is lifted up so that fuel is injected; a needle driving part disposed inside the valve body, the needle driving part driving the needle of the nozzle part; an upper pressure chamber formed above the needle driving part, the upper pressure chamber creating a pressure when the upper pressure chamber is filled with fuel fed through the fuel supply port, the pressure pressing the needle driving part in a downward direction; a lower pressure chamber positioned below the upper pressure chamber, the lower pressure chamber creating a pressure when the lower pressure chamber is filled up with fuel, the pressure pressing the needle driving part in an upward direction; a second flow path formed inside the valve body via the control valve housing, the second flow path being connected to the lower pressure chamber, such that fuel can be supplied the lower pressure chamber; a control needle disposed in the control valve housing, the control needle opening and closing the second flow path in response to a control signal, thereby controlling a flow rate of fuel that is supplied to the lower pressure chamber; a control chamber formed in the valve body so as to be connected to the lower pressure chamber, such that the control chamber is filled with fuel from the lower pressure chamber 231 when fuel is discharged; and a control orifice connected to the control chamber, and allows fuel inside the control chamber to be discharged out of the valve body.

In addition, the needle driving part may include: a spindle disposed inside the valve body such that the spindle can drive the needle of the nozzle part; a pressure piston disposed above the spindle, the pressure piston applying a downward force to the spindle under a pressure of fuel that fills the upper pressure chamber; and a spring disposed so as to be inserted into the pressure piston, the spring applying a downward force to the spindle.

In order to accomplish the above objects, the present invention also @provides an electronically controlled fuel injection valve that includes: a valve body having defined therein a first flow path along which fuel is fed through a fuel supply port, and having a control valve housing in an upper portion thereof; a nozzle part coupled to a lower portion of the valve body, and having defined therein a nozzle chamber which is filled with fuel that is supplied via the first flow path so that a needle disposed therein is pressed upward, whereby the needle is lifted up so that fuel is injected; a needle driving part disposed inside the valve body, the needle driving part driving the needle of the nozzle part; an upper pressure chamber formed above the needle driving part, the upper pressure chamber creating a pressure when the upper pressure chamber is filled with fuel fed through the fuel supply port, the pressure pressing the needle driving part in a downward direction; a lower pressure chamber positioned below the upper pressure chamber, the lower pressure chamber creating a pressure when the lower pressure chamber is filled up with fuel, the pressure pressing the needle driving part in an upward direction; a second flow path formed inside the needle pressing part via the control valve housing, the second flow path being connected to the lower pressure chamber, such that fuel can be supplied the lower pressure chamber; a control needle disposed in the control valve housing, the control needle opening and closing the second flow path in response to a control signal, thereby controlling a flow rate of fuel that is supplied to the lower pressure chamber; a control chamber formed in the valve body so as to be connected to the lower pressure chamber, such that the control chamber is filled with fuel from the lower pressure chamber when fuel is discharged; and a control orifice connected to the control chamber, and allows fuel inside the control chamber to be discharged out of the valve body.

In addition, the needle driving part may include: a spindle disposed inside the valve body so as to be positioned in a lower portion of the upper pressure chamber, the spindle applying a downward force to the needle of the nozzle part under a pressure of fuel that fills the upper pressure chamber; and a spring fitted into the spindle, the spring applying a downward force to the spindle.

Furthermore, the spindle may have a pressure acting surface having a stepped shape such that an upward driving force can act in response to a pressure of fuel that fills the lower pressure chamber.

As described above, the present invention has the following useful merits. It is possible to independently control the time to inject fuel and the amount of fuel to be injected in response to a control signal from the operating condition of an engine, unlike a traditional mechanical fuel injection valve. A control method for fuel injection increases the force of lifting up a cutoff needle of an injection controller by delivering high-pressure fuel to a lower pressure chamber via a control needle, thereby rapidly controlling fuel injection. The simplified structure facilitates replacement of parts. Since the spindle and the piston are separately fabricated such that surfaces which require precision machining are minimized, it is possible to facilitate precision machining of parts, thereby reducing fabrication cost. Since the second flow path is formed inside the spindle via the control valve housing, the structure of the flow path connected to the lower pressure chamber is simplified, thereby facilitating machining.

Figure 1:
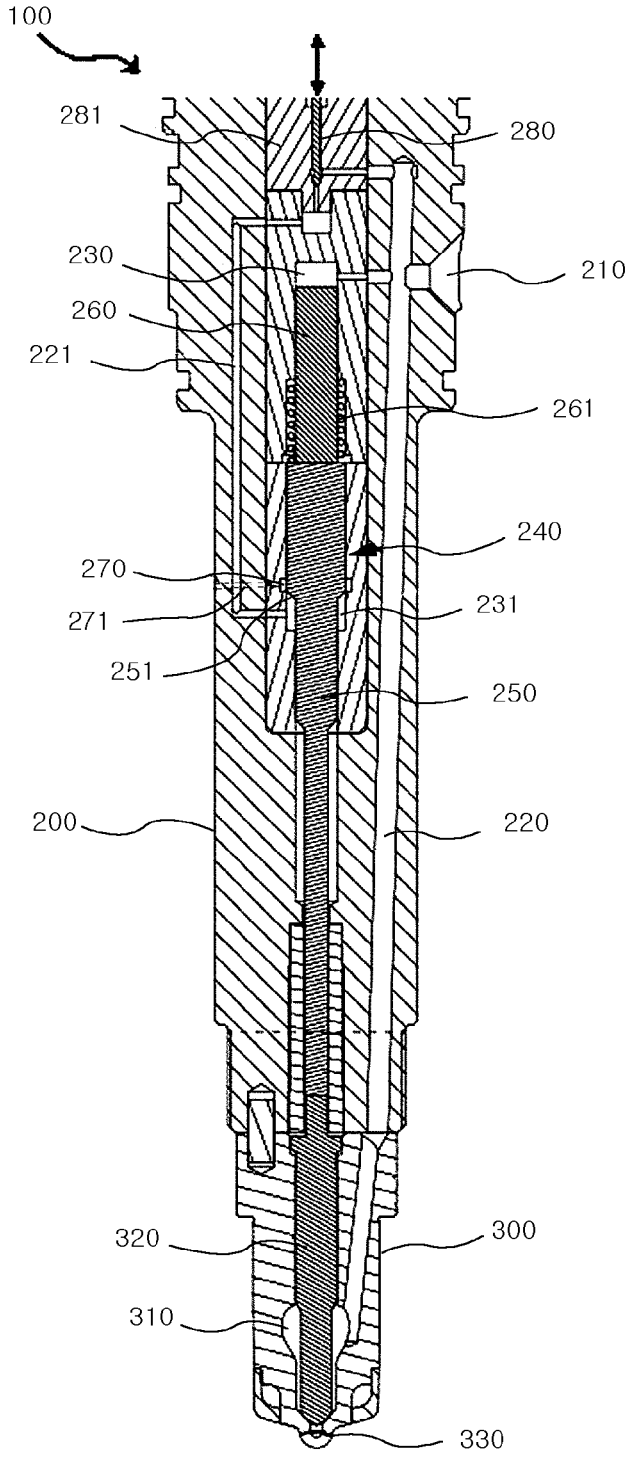
FIG. 1 is an example view showing a fuel injection valve according to a first embodiment of the present invention.

| <Description of the Reference Numerals in the Drawings> | |
|---|---|
| 100: fuel injection valve | 200: valve body |
| 210: fuel supply port | 220: first flow path |
| 221: second flow path | 230: upper pressure chamber |
| 231: lower pressure chamber | |
| 240: needle driving part | 250: spindle |
| 251: pressure acting surface | |
| 252: insertion hole | 253: connection hole |
| 260: pressure piston | 261: spring |
| 270: control chamber | 271: control orifice |
| 280: control needle | 281: control valve housing |
| 300: nozzle part | 310: nozzle chamber |
| 320: needle | 330: nozzle hole |

Mode for Invention

Reference will now be made in detail to embodiments of the present invention and their functions in conjunction with the accompanying drawings. In the following description of the present invention, detailed descriptions of known functions and components incorporated herein will be omitted when they may make the subject matter of the present invention unclear.

Figure 2:
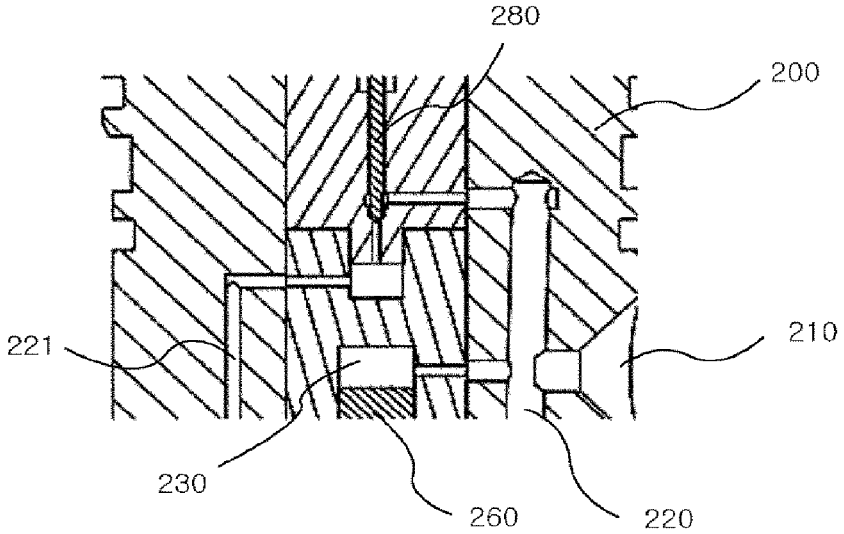
FIG. 2 is an example view specifically showing the installation structure of the control needle of the fuel injection valve according to the first embodiment of the present invention.
Figure 3:
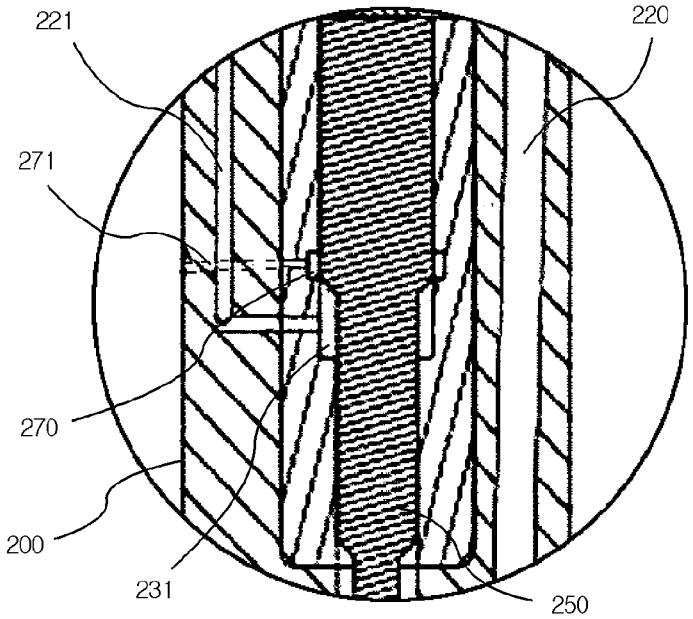
FIG. 3 is an example view specifically showing the structure of the spindle and the lower pressure chamber of the fuel injection valve according to the first embodiment of the present invention.
Figure 4:
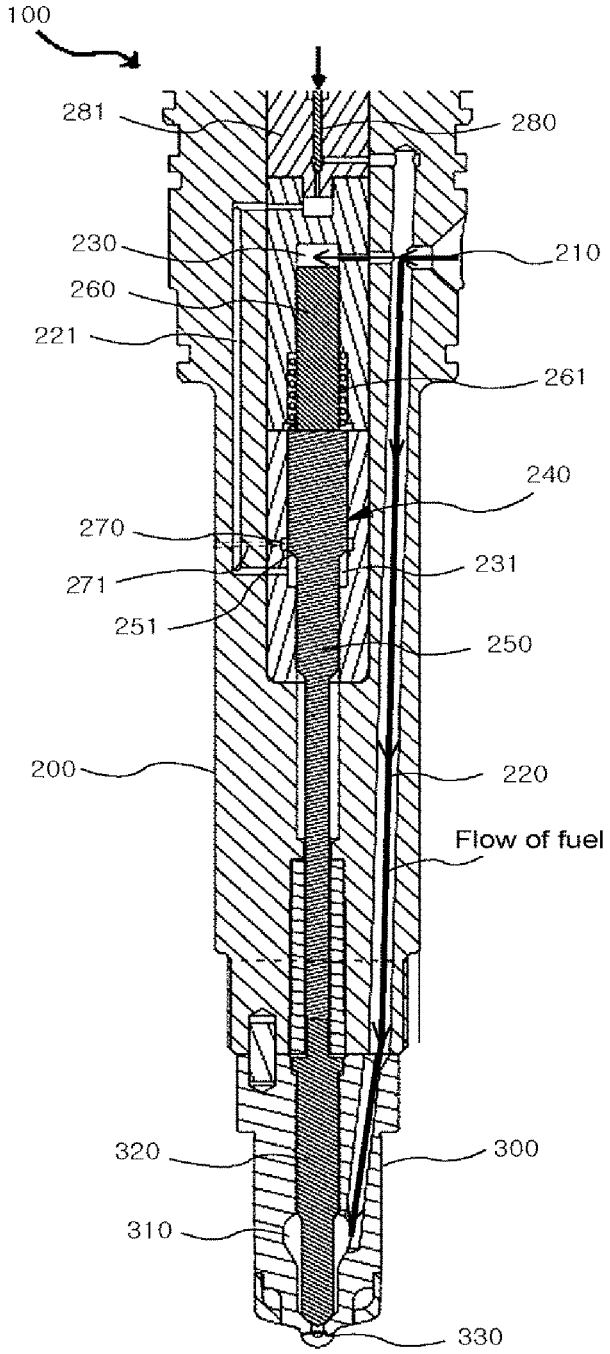
FIG. 4 is an example view showing the operating state and the flow of fuel when fuel is not injected in response to closing of the control needle of the fuel injection valve according to the first embodiment of the present invention.
Figure 5:
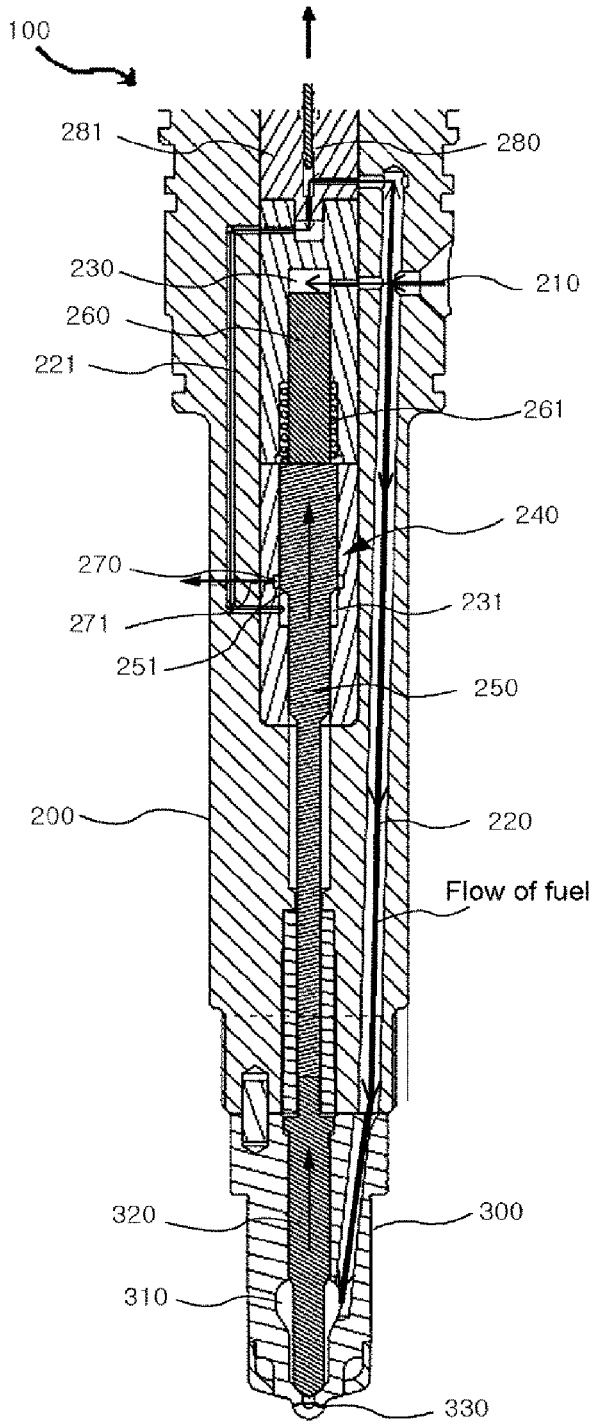
FIG. 5 is an example view showing the operating state and the flow of fuel when fuel is injected in response to opening of the control needle of the fuel injection valve according to the first embodiment of the present invention.
Figure 6:
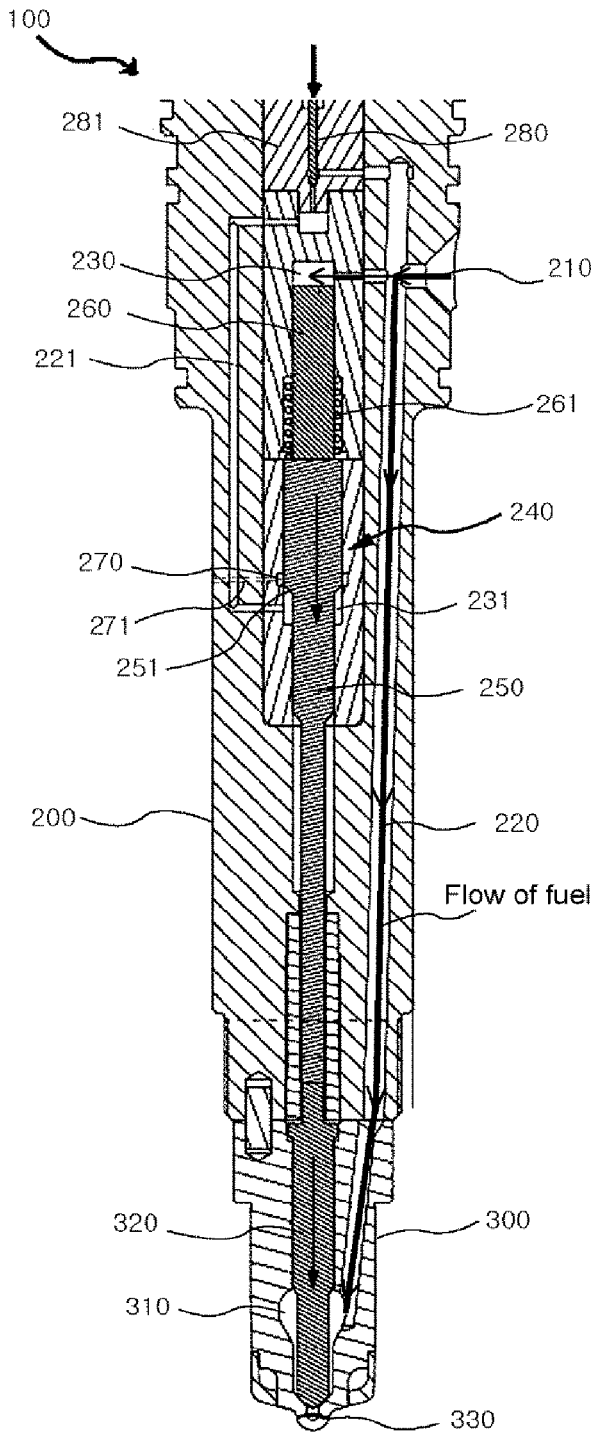
FIG. 6 is an example view showing the operating state and the flow of fuel when fuel injection is completed in response to re-closing of the control needle of the fuel injection valve according to the first embodiment of the present invention.

FIG. 1 is an example view showing a fuel injection valve according to a first embodiment of the present invention, FIG. 2 is an example view specifically showing the installation structure of the control needle of the fuel injection valve according to the first embodiment of the present invention, FIG. 3 is an example view specifically showing the structure of the spindle and the lower pressure chamber of the fuel injection valve according to the first embodiment of the present invention, FIG. 4 is an example view showing the operating state and the flow of fuel when fuel is not injected in response to closing of the control needle of the fuel injection valve according to the first embodiment of the present invention, FIG. 5 is an example view showing the operating state and the flow of fuel when fuel is injected in response to opening of the control needle of the fuel injection valve according to the first embodiment of the present invention, and FIG. 6 is an example view showing the operating state and the flow of fuel when fuel injection is completed in response to re-closing of the control needle of the fuel injection valve according to the first embodiment of the present invention.

As shown in the figures, the fuel injection valve 100 according to the present invention includes a valve body 200, a nozzle part 300, a needle driving part 240, an upper pressure chamber 230, a lower pressure chamber 231, a second flow path 221, a control needle 280, a control chamber 270 and a control orifice 271. The valve body 200 has defined therein a first flow path 220 along which fuel is fed through a fuel supply port 210, and has a control valve housing 281 in the upper portion thereof. The nozzle part 300 is coupled to the lower portion of the valve body 200, and has defined therein a nozzle chamber 310 which is filled with fuel that is supplied via the first flow path 220 so that a needle 320 disposed therein is pressed upward, whereby the needle 320 is lifted up so that fuel is injected toward a nozzle hole 330. The needle driving part 240 is disposed inside the valve body 200, and drives the needle 320 of the nozzle part 300. The upper pressure chamber 230 is formed above the needle driving part 240, and causes a pressure to form when it is filled with fuel fed through the fuel supply port 210, the pressure moving the needle driving part 240 in the downward direction. The lower pressure chamber 231 is positioned below the upper pressure chamber 230, and causes a pressure to form when it is filled up with fuel, the pressure pressing the needle driving part 240 in the upward direction. The second flow path 221 is formed inside the valve body 200 via the control valve housing 281, and is connected to the lower pressure chamber 231, such that the lower pressure chamber 231 can be filled with fuel that is supplied through the fuel supply port 210. The control needle 280 is disposed in the control valve housing 281, and opens and closes the second flow path 221 in response to a control signal, thereby controlling the flow rate of fuel that is supplied to the lower pressure chamber 231. The control chamber 270 is formed in the valve body 200 so as to be connected to the lower pressure chamber 231, such that it is filled with fuel from the lower pressure chamber 231 when fuel is discharged. The control orifice 271 is formed in the valve body 200 so as to be connected to the control chamber 270, and allows fuel that has filled inside the control chamber 270 to be discharged out of the valve body 200.

The control needle 280 is configured such that it can be actuated by an actuator (not shown) which operates in response to a control signal so as to open and close the second flow path 221, thereby controlling the flow rate of fuel that flows into the lower pressure chamber 231.

In the meantime, the needle driving part 240 includes a spindle 250, a pressure piston 260 and a spring 261. The spindle 250 is disposed inside the valve body 200 such that it can drive the needle 320 of the nozzle part 300. The pressure piston 260 is disposed above the spindle 250, and applies a downward force to the spindle 250 under the pressure of fuel that fills the upper pressure chamber 230. The spring 261 is disposed such that it is inserted into the pressure piston 260, and applies a downward force to the spindle 250.

In the first embodiment of the present invention, since the spindle 250 and the pressure piston 350 are separately provided, it is easy to adjust the intervals from the spindle 250 and the pressure piston 260 which require precision machining to the inner circumference of the valve body 200, and thus fabrication cost for the valve is reduced.

That is, the interval between the spindle 250 and the inner circumference of the valve body 200 and the interval between the pressure piston 260 and the inner circumference of the valve body 200 must be precisely machined to a very small size in order to prevent high-pressure fuel that fills the inside of the upper pressure chamber 230 and the lower pressure chamber 231 from leaking through the intervals. When the spindle 250 and the pressure piston 260 are formed integrally, machining is difficult since one part has a large number of surfaces that must be precisely machined. In contrast, the first embodiment of the present invention is designed such that the surfaces of each part that require precision machining are minimized by separately configuring the spindle 250 and the pressure piston 260. This consequently leads to an advantage in that it becomes easy to precisely machine the parts.

In addition, a pressure acting surface 251 having a stepped shape is formed on the spindle 250 such that a driving force can act in the upward direction in response to the pressure of fuel that fills the lower pressure chamber 231.

In addition, the control chamber 277 and the control orifice 271 are formed such that they are connected to the lower pressure chamber 231 to discharge fuel inside the lower pressure chamber 231 out of the valve body 200 when the spindle 250 is actuated in the upward direction. In contrast, when the spindle 250 is not actuated, the control chamber 277 and the control orifice 271 are disconnected from the lower pressure chamber 231 so that fuel is not discharged.

A description will be given of the operating state of the fuel injection valve having the above-described configuration according to the first embodiment of the present invention.

First, when fuel is not injected, high-pressure fuel that is supplied through the fuel supply port 210 fills the nozzle chamber 310 of the nozzle part 300 through the upper pressure chamber 230 which is formed above the pressure piston 350 and through the first flow path 220.

During the standby period in which fuel is not injected as such, fuel is not delivered to the lower pressure chamber 231 through the second flow path 221 since the control needle 280 stays closing the second flow path 221.

Then, the total of a force that acts in the downward direction on the upper portion of the pressure piston 260 under the pressure of fuel that has filled the upper pressure chamber 230 and a force from the spring 261 that acts in the downward direction is greater than a force acting in the upward direction on the needle 320 of the nozzle part 300 that is caused by the pressure that fills the nozzle chamber 310. Consequently, the needle 320 stays closed, whereby fuel is not injected through the nozzle hole 330.

When starting fuel injection, as the actuator operates in response to a control signal to lift up the control needle 280, the second flow path 221 which has been closed by the control needle 280 is opened, thereby allowing high-pressure fuel to be delivered to the lower pressure chamber 231. The pressure of fuel that fills the lower pressure chamber 231 acts on the pressure acting surface 251 of the spindle 320.

Accordingly, as the force for pushing the spindle 250 and the needle 320 of the needle 320 in the upward direction under the pressure of acting on the needle 320 caused by fuel that has filled up the nozzle chamber 310 of the nozzle 300 and the pressure acting on the spindle 250 caused by fuel that is filling the lower pressure chamber 231 becomes greater than the total of the force that fills the upper pressure chamber 230 and acts on the upper portion of the pressure piston 260 and the force from the spring 261 that acts in the downward direction, the spindle 250 and the needle 320 of the nozzle part 300 are lifted up, whereby fuel is injected through the nozzle hole 330.

When completing fuel injection, the control needle 280 moves downward in response to a control signal, thereby closing the second path 221 which is connected to the lower pressure chamber 231.

When the second flow path 221 is closed as such, fuel is no longer supplied to the lower pressure chamber 231 but is discharged through control orifice 270, so that the pressure inside the lower pressure chamber 231 decreases.

Then, the force for lifting up the spindle 320 and the needle 320 of the nozzle part 300 caused by the pressure of fuel becomes smaller than the total of the force for pressing down the spindle 250 and the needle 320 of the nozzle part 300 caused by the pressure that acts on the upper portion of the pressure piston 260 and the force from the spring 261. Consequently, the needle 320 of the nozzle part 300 moves downward to close the flow path, thereby completing fuel injection through the nozzle hole 330.

In the fuel injection valve according to the first embodiment of the present invention as described above, the control needle 280 can operate in response to a control signal to control the time to inject fuel and the amount of fuel to be injected independently from the operating condition of an engine unlike the traditional mechanical fuel injection valve.

In addition, a control method for fuel injection is to increase the force of lifting up the needle 320 of the nozzle part 300 by delivering high-pressure fuel to the lower pressure chamber 231 via the control needle 280, so that control over fuel injection can be rapidly performed.

Furthermore, the spindle 250 and the pressure piston 260 are designed such that they are separately fabricated such that surfaces of each part which require precision machining are minimized. This leads to an advantage in that precision machining of parts is easy.

In addition, parts can be easily assembled and replaced due to the simple structure. In particular, there is an advantage in that the nozzle part can be easily replaced.

Figure 7:
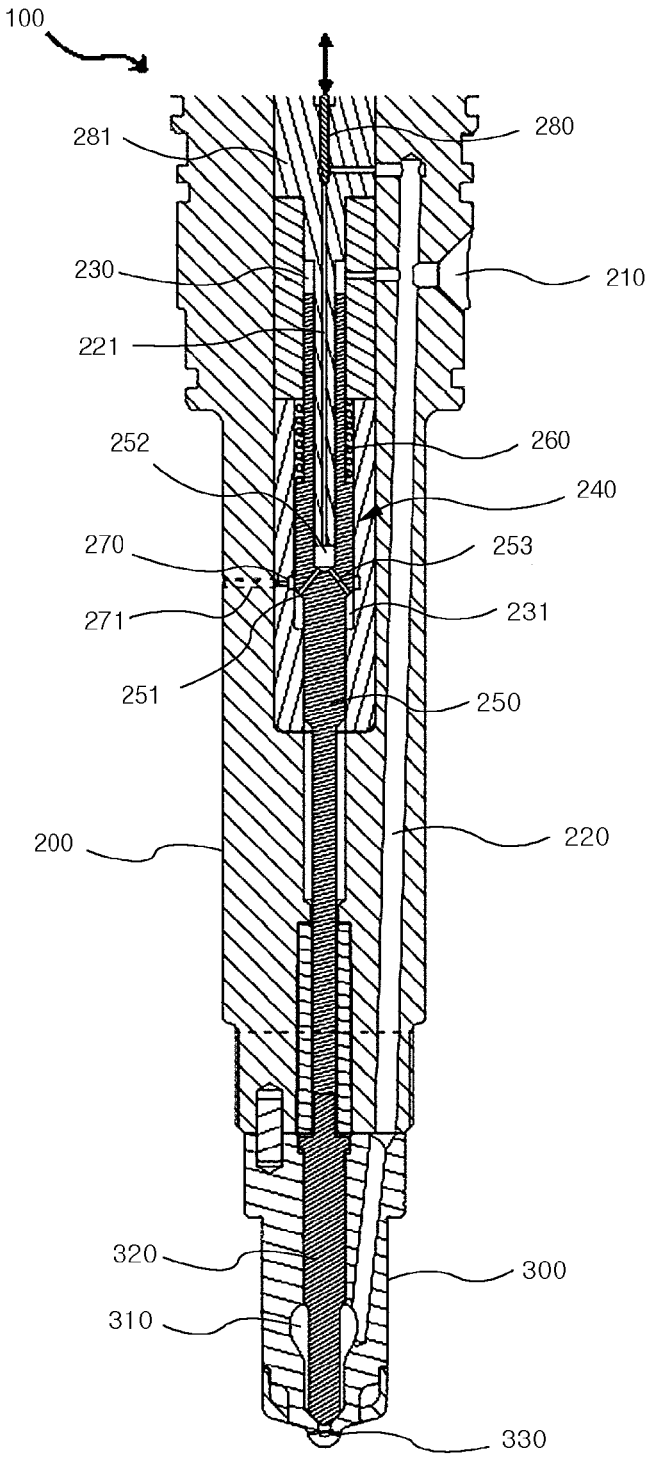
FIG. 7 is an example view showing a fuel injection valve according to a second embodiment of the present invention.
Figure 8:
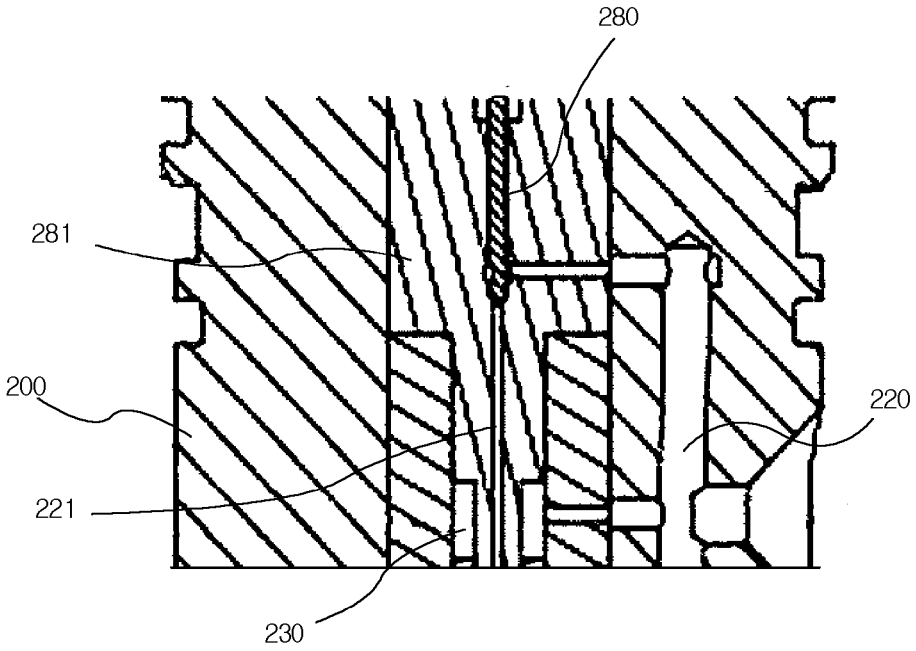
FIG. 8 is an example view specifically showing the installation structure of the control needle of the fuel injection valve according to the second embodiment of the present invention.
Figure 9:
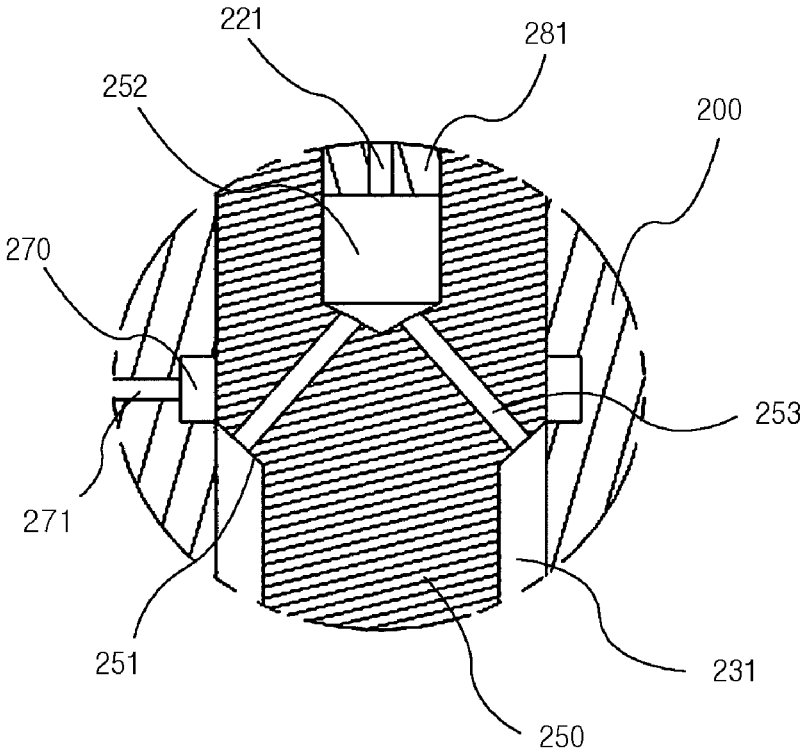
FIG. 9 is an example view specifically showing the structure of the spindle and the lower pressure chamber of the fuel injection valve according to the second embodiment of the present invention.
Figure 10:
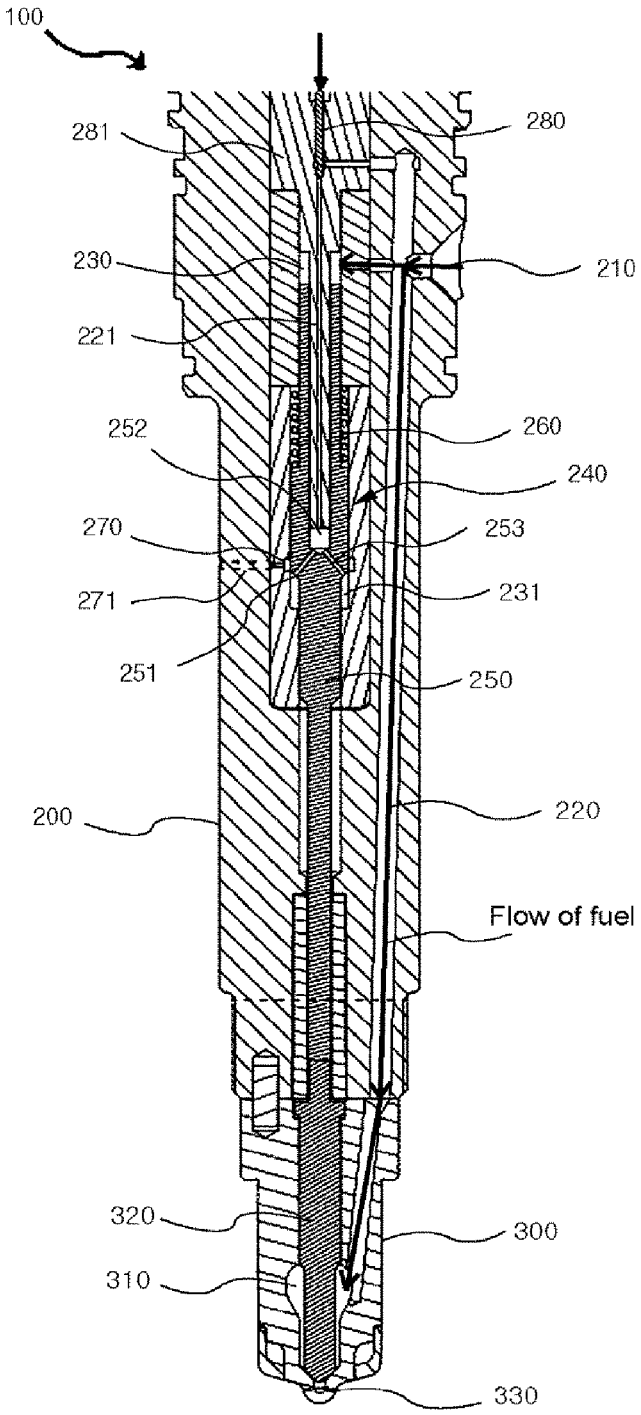
FIG. 10 is an example view showing the operating state and the flow of fuel when fuel is not injected in response to closing of the control needle of the fuel injection valve according to the second embodiment of the present invention.
Figure 11:
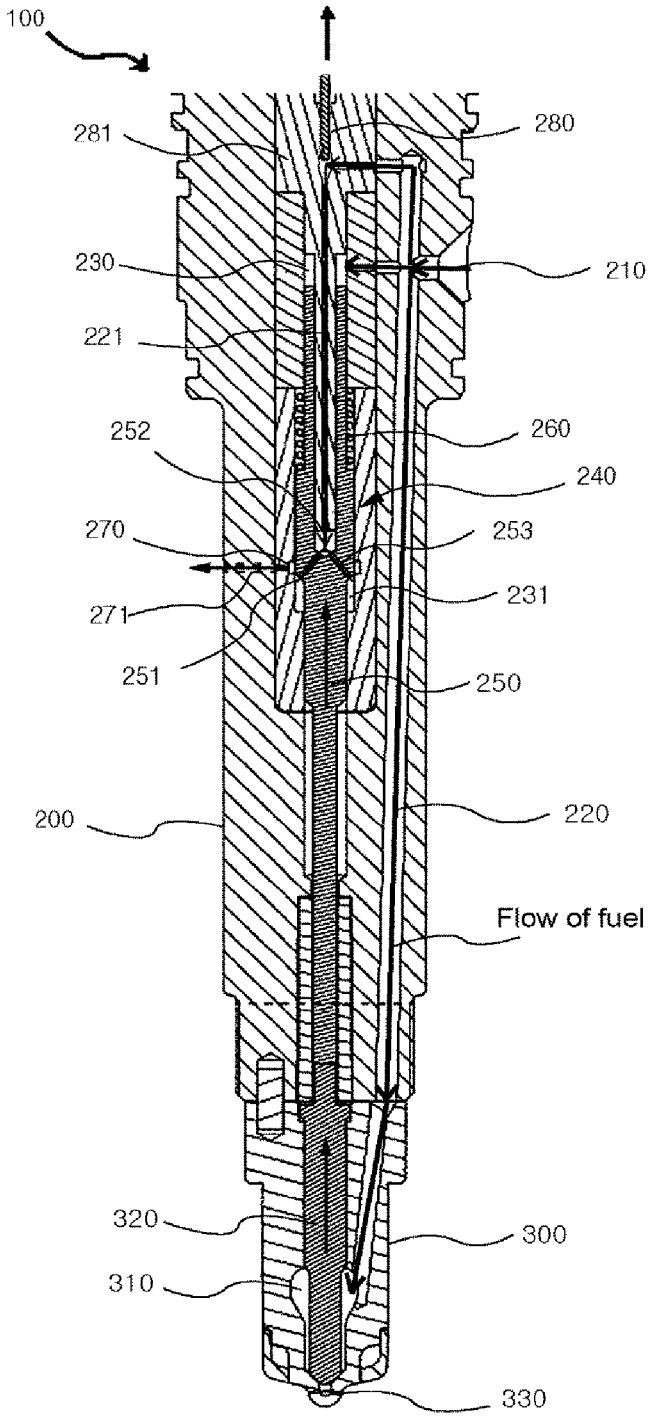
FIG. 11 is an example view showing the operating state and the flow of fuel when fuel is injected in response to opening of the control needle of the fuel injection valve according to the second embodiment of the present invention.
Figure 12:
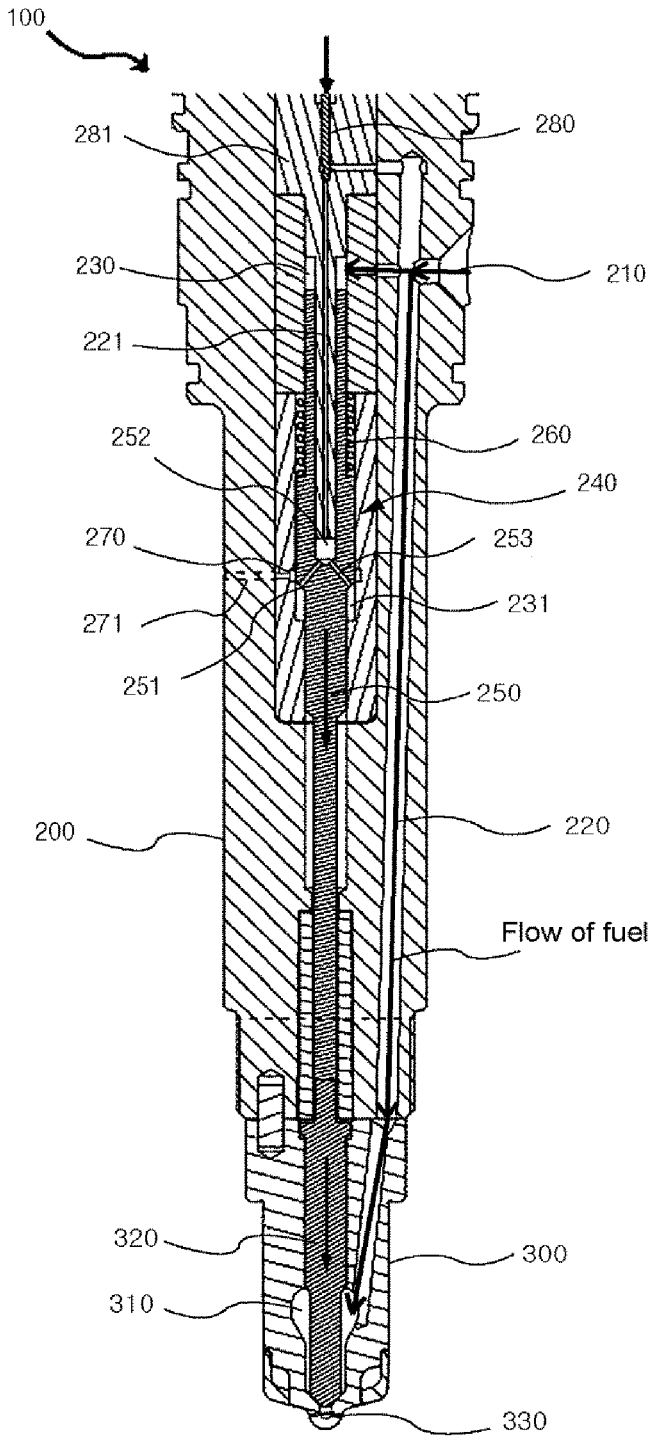
FIG. 12 is an example view showing the operating state and the flow of fuel when fuel injection is completed in response to re-closing of the control needle of the fuel injection valve according to the second embodiment of the present invention.

FIG. 7 is an example view showing a fuel injection valve according to a second embodiment of the present invention, FIG. 8 is an example view specifically showing the installation structure of the control needle of the fuel injection valve according to the second embodiment of the present invention, FIG. 9 is an example view specifically showing the structure of the spindle and the lower pressure chamber of the fuel injection valve according to the second embodiment of the present invention, FIG. 10 is an example view showing the operating state and the flow of fuel when fuel is not injected in response to closing of the control needle of the fuel injection valve according to the second embodiment of the present invention, FIG. 11 is an example view showing the operating state and the flow of fuel when fuel is injected in response to opening of the control needle of the fuel injection valve according to the second embodiment of the present invention, and FIG. 12 is an example view showing the operating state and the flow of fuel when fuel injection is completed in response to re-closing of the control needle of the fuel injection valve according to the second embodiment of the present invention.

As shown in the figures, the fuel injection valve 100 according to the second embodiment of the present invention includes a valve body 200, a nozzle part 300, a needle driving part 240, an upper pressure chamber 230, a lower pressure chamber 231, a second flow path 221, a control needle 280, a control chamber 270 and a control orifice 271. The valve body 200 has defined therein a first flow path 220 along which fuel is fed through a fuel supply port 210, and has a control valve housing 281 in the upper portion thereof. The nozzle part 300 is coupled to the lower portion of the valve body 200, and has defined therein a nozzle chamber 310 which is filled with fuel that is supplied via the first flow path 220 so that a needle 320 disposed therein is pressed upward, whereby the needle 320 is lifted up so that fuel is injected toward a nozzle hole 330. The needle driving part 240 is disposed inside the valve body 200, and drives the needle 320 of the nozzle part 300. The upper pressure chamber 230 is formed above the needle driving part 240, and creates a pressure when it is filled with fuel fed through the fuel supply port 210, the pressure moving the needle driving part 240 in the downward direction. The lower pressure chamber 231 is positioned below the upper pressure chamber 230, and creates a pressure when it is filled up with fuel, the pressure pressing the needle driving part 240 in the upward direction. The second flow path 221 is formed inside the needle driving part 240 via the control valve housing 281, and is connected to the lower pressure chamber 231 such that fuel can be supplied the lower pressure chamber 231. The control needle 280 is disposed in the control valve housing 281, and opens and closes the second flow path 221 in response to a control signal, thereby controlling the flow rate of fuel that is supplied to the lower pressure chamber 231. The control chamber 270 is formed in the valve body 200 so as to be connected to the lower pressure chamber 231, such that it is filled with fuel from the lower pressure chamber 231 when fuel is discharged. The control orifice 271 is formed in the valve body 200 so as to be connected to the control chamber 270, and allows fuel that has filled inside the control chamber 270 to be discharged out of the valve body 200.

The control needle 280 is configured such that it can be actuated by an actuator (not shown) which operates in response to a control signal so as to open and close the second flow path 221, thereby controlling the flow rate of fuel that flows into the lower pressure chamber 231.

The needle driving part 240 includes a spindle 250 and a spring 261. The spindle 250 is disposed inside the valve body 200 such that it is positioned in the lower portion of the upper pressure chamber 230, and applies a downward force to the needle 320 of the nozzle part 300 under the pressure of fuel that fills the upper pressure chamber 230. The spring 261 is fitted into the spindle 250, and applies a downward force to the spindle 250.

The spindle 250 has an insertion hole 252 into which the control valve housing 281 can be inserted.

Since the control valve housing 281 in which the second flow path 221 is formed is inserted into and coupled to the insertion hole 252, the second flow path 221 is positioned inside the spindle 250. Consequently, the second flow path 221 has a simple structure, and thus can be easily machined.

In addition, a plurality of connection holes 253 is formed in the insertion hole 252. The connection holes 253 are connected to the lower pressure chamber 231 such that fuel that feeds through the second flow path 221 can be supplied to the lower pressure chamber 231 which is formed outside the spindle 250.

In addition, a pressure acting surface 251 which has a stepped shape is formed on the spindle 250 such that a driving force can act in the upward direction in response to the pressure of fuel that fills the lower pressure chamber 231.

In addition, the control chamber 277 and the control orifice 271 are formed such that they are connected to the lower pressure chamber 231 to discharge fuel inside the lower pressure chamber 231 out of the valve body 200 when the spindle 250 is actuated in the upward direction. In contrast, when the spindle 250 is not actuated, the control chamber 277 and the control orifice 271 are disconnected from the lower pressure chamber 231 so that fuel is not discharged.

A description will be given of the operating state of the fuel injection valve having the above-described configuration according to the second embodiment of the present invention.

First, when fuel is not injected, high-pressure fuel that is supplied through the fuel supply port 210 fills the nozzle chamber 310 of the nozzle part 300 through the upper pressure chamber 230 which is formed above the pressure piston 350 and through the first flow path 220.

During the standby period in which fuel is not injected as such, fuel is not delivered to the lower pressure chamber 231 through the second flow path 221 since the control needle 280 stays closing the second flow path 221.

Then, the total of a force that acts in the downward direction on the upper portion of the spindle 250 under the pressure of fuel that has filled the upper pressure chamber 230 and a force from the spring 261 that acts in the downward direction is greater than a force acting in the upward direction on the needle 320 of the nozzle part 300 that is caused by the pressure that fills the nozzle chamber 310. Consequently, the needle 320 stays closed, whereby fuel is not injected through the nozzle hole 330.

When starting fuel injection, as the actuator operates in response to a control signal to lift up the control needle 280, the second flow path 221 which has been closed by the control needle 280 is opened, thereby allowing high-pressure fuel to be delivered to the lower pressure chamber 231 through the connection holes 253 inside the spindle 250. The pressure of fuel that fills the lower pressure chamber 231 acts on the pressure acting surface 251 of the spindle 320.

Accordingly, as the force for pushing the spindle 250 and the needle 320 of the needle 320 in the upward direction, under the pressure of acting on the needle 320 caused by fuel that has filled up the nozzle chamber 310 of the nozzle 300 and the pressure acting on the spindle 250 caused by fuel that is filling the lower pressure chamber 231, becomes greater than the total of the force that fills the upper pressure chamber 230 and acts on the upper portion of the spindle 250 and the force from the spring 261 that acts in the downward direction, the spindle 250 and the needle 320 of the nozzle part 300 are lifted up, whereby fuel is injected through the nozzle hole 330.

When completing fuel injection, the control needle 280 moves downward in response to a control signal, thereby closing the second path 221 which is connected to the lower pressure chamber 231.

When the second flow path 221 is closed as such, fuel is no longer supplied to the lower pressure chamber 231 but is discharged through control orifice 270 so that the pressure inside the lower pressure chamber 231 decreases.

Then, the force for lifting up the spindle 320 and the needle 320 of the nozzle part 300 caused by the pressure of fuel becomes smaller than the total of the force for pressing down the spindle 250 and the needle 320 of the nozzle part 300 caused by the pressure that acts on the upper portion of the spindle 250 and the force from the spring 261. Consequently, the needle 320 of the nozzle part 300 moves downward to close the flow path, thereby completing fuel injection through the nozzle hole 330.

In the fuel injection valve according to the present invention as described above, the control needle 280 can operate in response to a control signal to control the time to inject fuel and the amount of fuel to be injected independently from the operating condition of an engine unlike the traditional mechanical fuel injection valve.

In addition, a control method for fuel injection is to increase the force of lifting up the needle 320 of the nozzle part 300 by delivering high-pressure fuel to the lower pressure chamber 231 via the control needle 280, so that control over fuel injection can be rapidly performed.

Furthermore, since the structure of the second flow path is simplified, fabrication is simplified and parts can be easily assembled and replaced.

Although the present invention has been described hereinabove with respect to the certain exemplary embodiments, it should be understood that the present invention is not limited to the foregoing embodiments. It is apparent to a person having ordinary skill in the art to which the present invention belongs that a variety of changes can be made without departing from the concept of the present invention that is defined in the appended claims, and that such changes fall within the scope of the claims.

What is claimed is:

1. An electronically controlled fuel injection valve comprising:

a valve body having defined therein a first flow path along which fuel is fed through a fuel supply port, and having a control valve housing in an upper portion thereof;

a nozzle part coupled to a lower portion of the valve body, and having defined therein a nozzle chamber which is filled with fuel that is supplied via the first flow path so that a needle disposed therein is pressed upward, whereby the needle is lifted up so that fuel is injected;

a needle driving part disposed inside the valve body, the needle driving part driving the needle of the nozzle part;

an upper pressure chamber formed above the needle driving part, the upper pressure chamber creating a pressure when the upper pressure chamber is filled with fuel fed through the fuel supply port, the pressure pressing the needle driving part in a downward direction;

a lower pressure chamber positioned below the upper pressure chamber, the lower pressure chamber creating a pressure when the lower pressure chamber is filled up with fuel, the pressure pressing the needle driving part in an upward direction;

a second flow path formed inside the valve body via the control valve housing, the second flow path being connected to the lower pressure chamber, such that fuel is supplied the lower pressure chamber;

a control needle disposed in the control valve housing, the control needle opening and closing the second flow path in response to a control signal, thereby controlling a flow rate of fuel that is supplied to the lower pressure chamber;

a control chamber formed in the valve body so as to be connected to the lower pressure chamber, such that the control chamber is filled with fuel from the lower pressure chamber when fuel is discharged; and a control orifice connected to the control chamber, and allows fuel inside the control chamber to be discharged out of the valve body.

2. The electronically controlled fuel injection valve according to claim 1, wherein the needle driving part comprises:

a spindle disposed inside the valve body such that the spindle drives the needle of the nozzle part;

a pressure piston disposed above the spindle, the pressure piston applying a downward force to the spindle under a pressure of fuel that fills the upper pressure chamber; and a spring disposed so as to be inserted into the pressure piston, the spring applying a downward force to the spindle.

3. The electronically controlled fuel injection valve according to claim 1, wherein the spindle has a pressure acting surface having a stepped shape such that an upward driving force acts in response to a pressure of fuel that fills the lower pressure chamber.

4. The electronically controlled fuel injection valve according to claim 2, wherein the spindle has a pressure acting surface having a stepped shape such that an upward driving force acts in response to a pressure of fuel that fills the lower pressure chamber.

* * * * *